US007392677B1

(12) United States Patent
Fan

(10) Patent No.: US 7,392,677 B1
(45) Date of Patent: Jul. 1, 2008

(54) LOCK CORE STRUCTURE

(75) Inventor: Tso-Pin Fan, Taipei County (TW)

(73) Assignee: Porter Lock Co., Ltd., Taipei County (TW)

( * ) Notice: Subject to any disclaimer, the term of this patent is extended or adjusted under 35 U.S.C. 154(b) by 0 days.

(21) Appl. No.: 11/656,492

(22) Filed: Jan. 23, 2007

(51) Int. Cl.
*E05B 27/00* (2006.01)

(52) U.S. Cl. ..... 70/495; 70/492; 70/377

(58) Field of Classification Search ..... 70/376, 70/377, 492, 495
See application file for complete search history.

(56) References Cited

U.S. PATENT DOCUMENTS

| | | | | | |
|---|---|---|---|---|---|
| 2,030,836 | A * | 2/1936 | Full et al. | ..... | 70/358 |
| 2,039,126 | A * | 4/1936 | Svoboda | ..... | 70/358 |
| 2,047,966 | A * | 7/1936 | Jacobi | ..... | 70/492 |
| 2,079,628 | A * | 5/1937 | Olson | ..... | 70/492 |
| 2,123,940 | A * | 7/1938 | Gray | ..... | 70/492 |
| 2,155,440 | A * | 4/1939 | Olson | ..... | 70/358 |
| 2,155,734 | A * | 4/1939 | Olson | ..... | 70/358 |
| 2,248,475 | A * | 7/1941 | Hamilton | ..... | 70/492 |
| 2,375,682 | A * | 5/1945 | Olson | ..... | 70/492 |
| 3,035,433 | A * | 5/1962 | Testa | ..... | 70/495 |
| 3,263,461 | A * | 8/1966 | Tartaglia | ..... | 70/383 |
| 3,509,749 | A * | 5/1970 | Arzig et al. | ..... | 70/492 |
| 3,581,534 | A * | 6/1971 | Testa | ..... | 70/383 |
| 3,707,863 | A * | 1/1973 | Schwab et al. | ..... | 70/492 |
| 3,735,614 | A * | 5/1973 | Keller-Volper | ..... | 70/377 |
| 3,988,912 | A * | 11/1976 | Rogers | ..... | 70/492 |
| 4,376,382 | A * | 3/1983 | Raymond et al. | ..... | 70/338 |
| 4,966,021 | A * | 10/1990 | Boag | ..... | 70/383 |
| 5,174,141 | A * | 12/1992 | Ohyabu | ..... | 70/492 |
| 5,653,131 | A * | 8/1997 | Shibata et al. | ..... | 70/185 |
| 5,956,986 | A * | 9/1999 | Vonlanthen | ..... | 70/492 |
| 6,041,631 | A * | 3/2000 | Vonlanthen | ..... | 70/492 |
| 6,427,506 | B1 * | 8/2002 | Prunbauer | ..... | 70/495 |
| 6,477,876 | B1 * | 11/2002 | Kim | ..... | 70/495 |
| 6,481,255 | B2 * | 11/2002 | Theriault et al. | ..... | 70/495 |
| 6,755,063 | B2 * | 6/2004 | Takadama | ..... | 70/495 |
| 6,968,717 | B2 * | 11/2005 | Suzuki et al. | ..... | 70/492 |
| 6,973,813 | B2 * | 12/2005 | Erdely | ..... | 70/492 |

FOREIGN PATENT DOCUMENTS

| | | | |
|---|---|---|---|
| TW | 094216537 | U | 2/2006 |
| TW | 094219454 | U | 6/2006 |
| TW | 094145435 | B | 10/2006 |
| TW | 095206477 | U | 12/2006 |

* cited by examiner

*Primary Examiner*—Suzanne Dino Barrett
(74) *Attorney, Agent, or Firm*—Muncy, Geissler, Olds & Lowe, PLLC

(57) ABSTRACT

A lock core structure including a housing, a lock core, at least two latch elements and plural lock piece sets. Each lock piece set includes a division plate and a first lock piece and the second lock piece are embedded in two sliding tracks on the division plate, and an elastic element is mounted between the first lock piece and the second lock piece for interlocking the first and the second lock pieces. Through the interlocked structure between the first lock piece and the second lock piece, it will be harder for the thief to break the lock core.

10 Claims, 6 Drawing Sheets

LOCK CORE STRUCTURE

FIELD OF THE INVENTION

The present invention is related to a lock core, and more particularly to a lock core which has plural lock piece sets embedded therein for cooperating with plural latches so as to form a latching mechanism.

BACKGROUND OF THE INVENTION

Generally, according to the lock core, the common lock can be classified as pin tumbler lock and plate lock. The pin tumbler lock utilizes various sizes of ball-typed or pillar-typed bolts in the lock core, and each indentation on the key will correspond and match to each different bolts, so that the lock can be opened. In the plate lock, each lock piece set has an indentation, and the indentations are interlocked and simultaneously rejected against one latch element so as to lock the lock core. The examples of conventional pin tumbler lock are R.O.C Patent Application No. 094219454 "Anti-theft lock core structure" and R.O.C Patent Application NO. 094216537 "Anti-theft lock core assembly structure"; and the examples of plate lock are R.O.C Patent Application No. 095206477 "Lock core assembly for door lock" and R.O.C Patent Application No. 094145435 "Anti-theft lock core". However, in the conventional pin tumbler lock or plate lock, there is only one barrier for each bolt or lock piece, and there is no interlocking in each set of bolts or lock pieces, so that the thief can easily open the door by respectively breaking each barrier. Therefore, the conventional lock core structure still needs to be improved and enhanced.

SUMMARY OF THE INVENTION

Consequently, the object of the present invention is to provide a lock core structure in which multiple locks are interlocked, so that the lock can not be broken by the thief easily.

The present invention provides a lock core structure including a housing, a lock core, at least two latch elements and plural lock piece sets. Each lock piece set includes a division plate and a first lock piece and a second lock piece, wherein the first lock piece and the second lock piece are embedded in two sliding tracks on the division plate, and an elastic element is mounted between the first lock piece and the second lock piece for interlocking the first and the second lock pieces. Moreover, the first lock piece and the second lock piece respectively have a first embedding slot and a second embedding slot corresponding to the fixing troughs at the two sides of the division plate, and when the first embedding slot and the second embedding slot are aligned with the fixing troughs, the lock can be opened. Furthermore, because the interlocked structure between the first lock piece and the second lock piece, even if the thief tries to reject any one of the first or the second lock piece, it still is difficult to break the lock core.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1A:
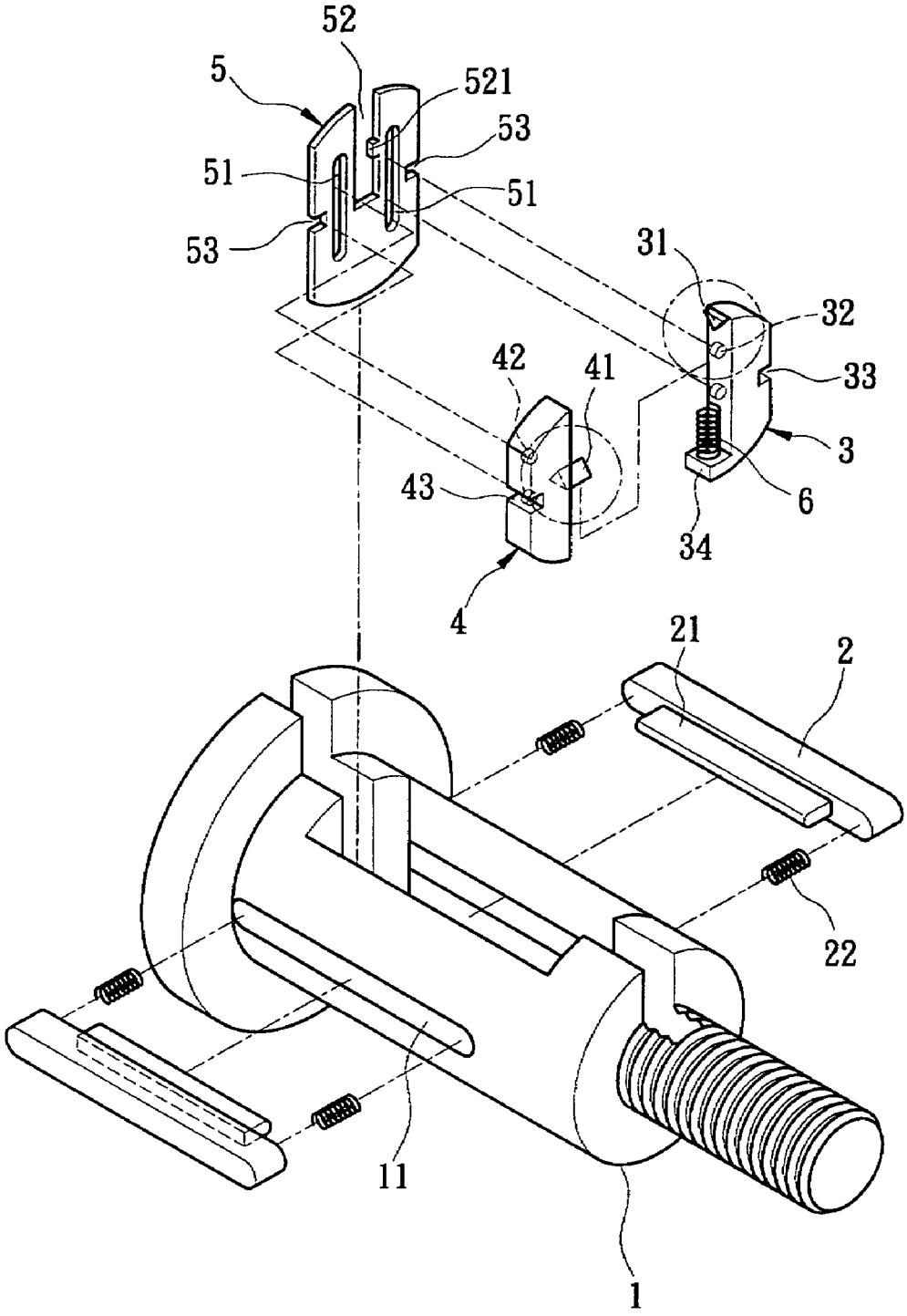
FIG. 1A is a decomposition drawing of the present invention.
Figure 1B:
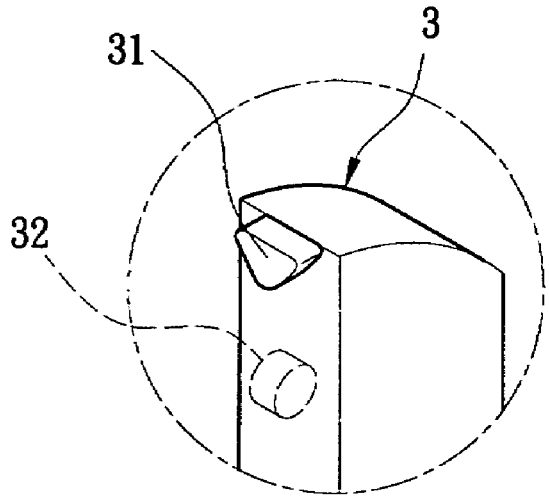
FIG. 1B is a partial magnification drawing showing a second lock piece.
Figure 1C:
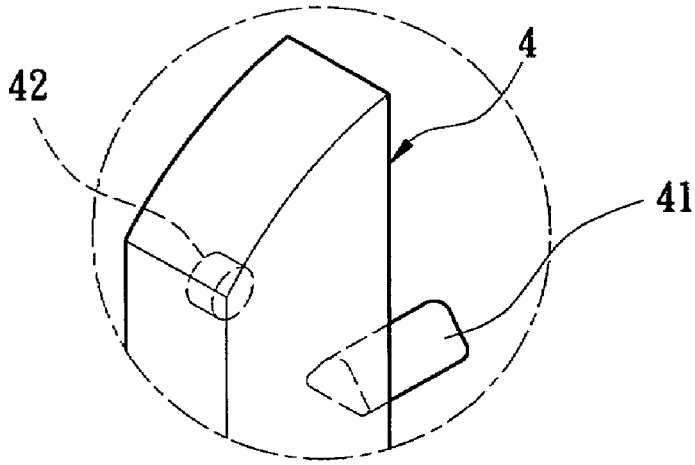
FIG. 1C is a partial magnification drawing showing a first lock piece.
Figure 2:
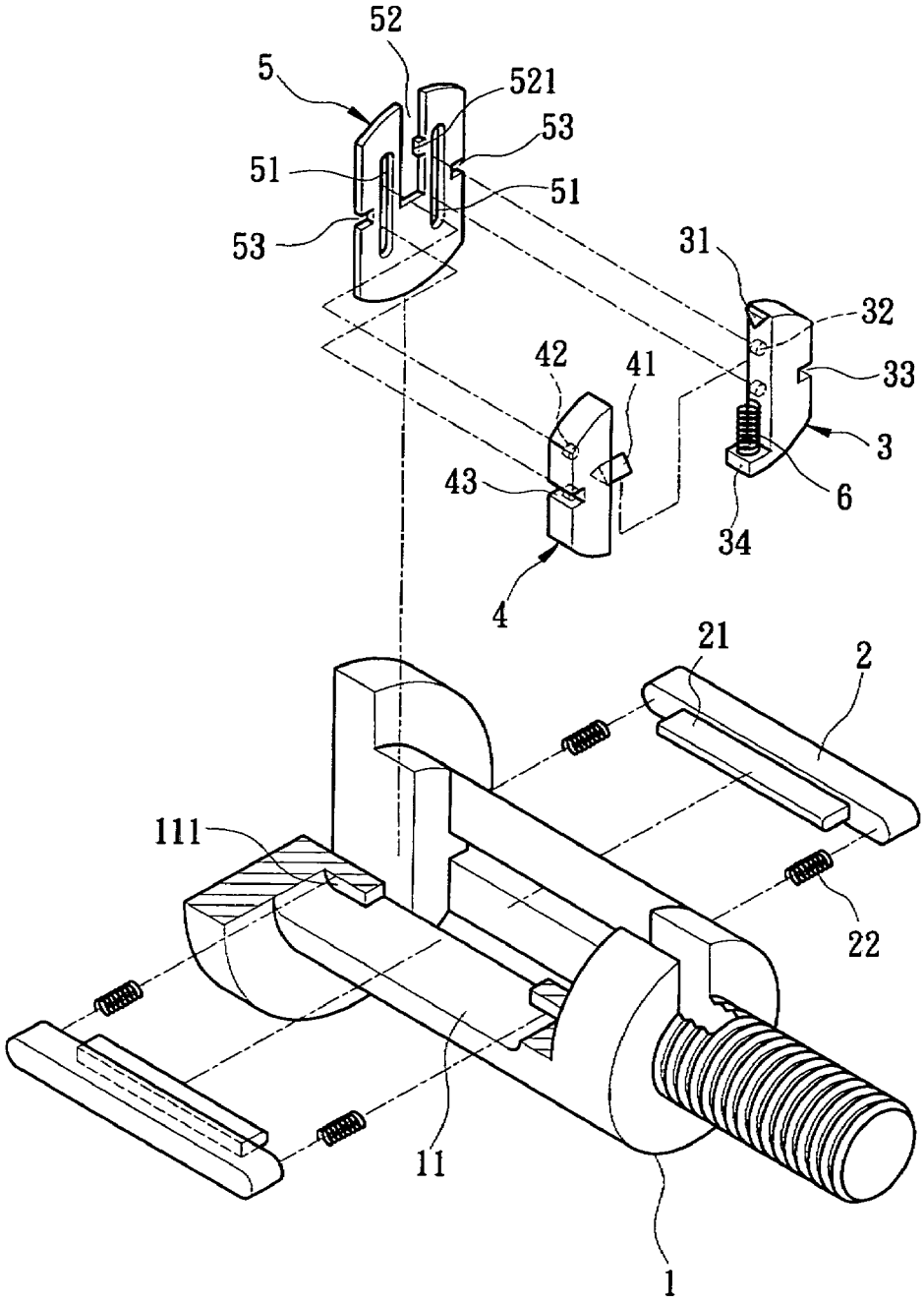
FIG. 2 is a decomposition drawing showing a partial sectional view of a lock core and the decomposition drawing of a lock piece set.

Please refer to FIGS. 1A and 2, which are decomposition drawings respectively showing a lock core 1 and lock piece set. A lock core structure includes a lock core 1, two latch elements 2 and plural lock piece sets embedded in the lock core 1, wherein the lock core 1 has a space dug for embedding therein plural lock piece sets and also has embedding holes mounted at two sides thereof for positioning the latch elements 2, each of the latch elements 2 further has a bulge 21 mounted thereon, and each of the embedding holes 11 has plural rejecting blocks 111 mounted therein and a latch spring 22 rejected between the latch element 2 and the rejecting block 111. Furthermore, each lock piece set includes a division plate 5, a first lock piece 4, a second lock piece 3 and an elastic element 6 located between the first and the second lock pieces 4, 3, wherein the division plate 5 has a key through hole 52 mounted at the center thereof for passing through a key 8 (shown in FIG. 5B) and a key orientation element 521 mounted around the key through hole 52 for orientating the key, a sliding track 51 respectively mounted at two sides of the key through hole 52, and a fixing trough 53 respectively located at two sides of the division plate 5 corresponding to the embedding holes 11 of the lock core 1, and the first lock piece 4 and the second lock piece 3 both have two sliding elements 42, 32 for guiding the first lock piece 4 and the second lock piece 3 to move along the sliding tracks 51 on the division plate 5. Besides, the first lock piece 4 has a first key rejecting shaft 41 protrudently mounted at one side thereof near the key through hole 52 so as to correspond to a first embedding slot 43 located at one side of the fixing trough 53, and the second lock piece 3 also has sliding elements 32 for moving along the sliding track of the division plate 5 so as to correspond to a second embedding slot 33 located at one side of the fixing trough 53. In addition, the second lock piece 3 also has a second key rejecting shaft 31 protrudently mounted at one side thereof near the key through hole 52. The first key rejecting shaft 41 and the second key rejecting shaft 31 are respectively mounted in front of the key through hole 52 at the top and the bottom, and a rejecting shaft 34 is further mounted at the lower end of the second lock piece 3 so that an elastic element 6 can be mounted between the rejecting shaft 34 and the first key rejecting shaft 41, and the elastic element 6 is simultaneously rejected at the first key rejecting shaft 41 of the first lock piece 4 and the rejecting shaft 34 of the second lock piece 3 so as to form an interlocked structure. Please refer to FIGS. 1B and 1C, which are partial enlargements of the first lock piece 4 and the second lock piece 3. The first key rejecting shaft 41 and the second key rejecting shaft 31 have two inclined planes and approximately have a triangular sectional area, and the first key rejecting shaft 41 and the second key rejecting shaft 31 are mounted in front of the key through hole 52 of the division plate 5 in an opposite direction.

Figure 3:
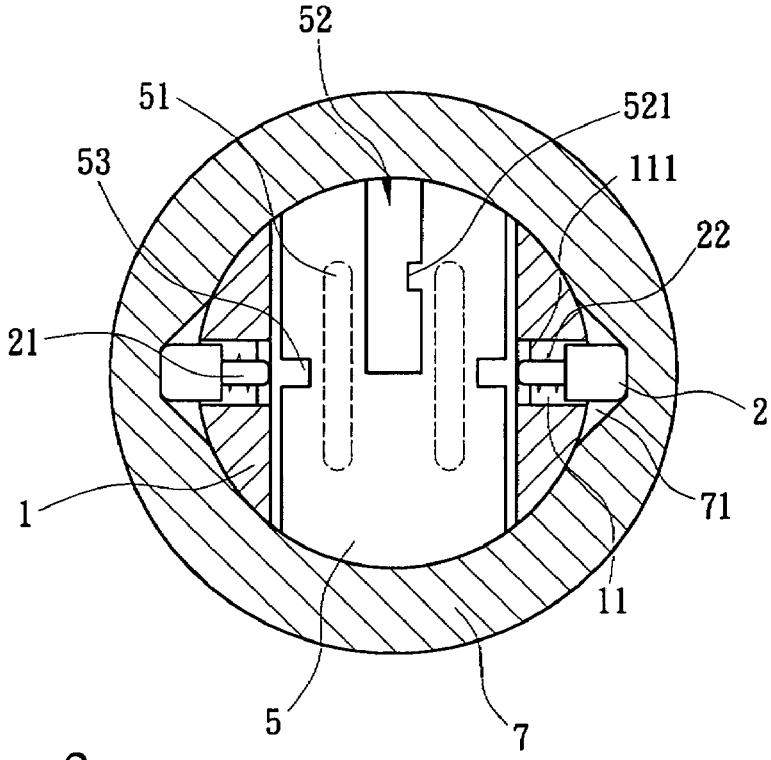
FIG. 3 is a first sectional view showing the lock core structure.
Figure 4:
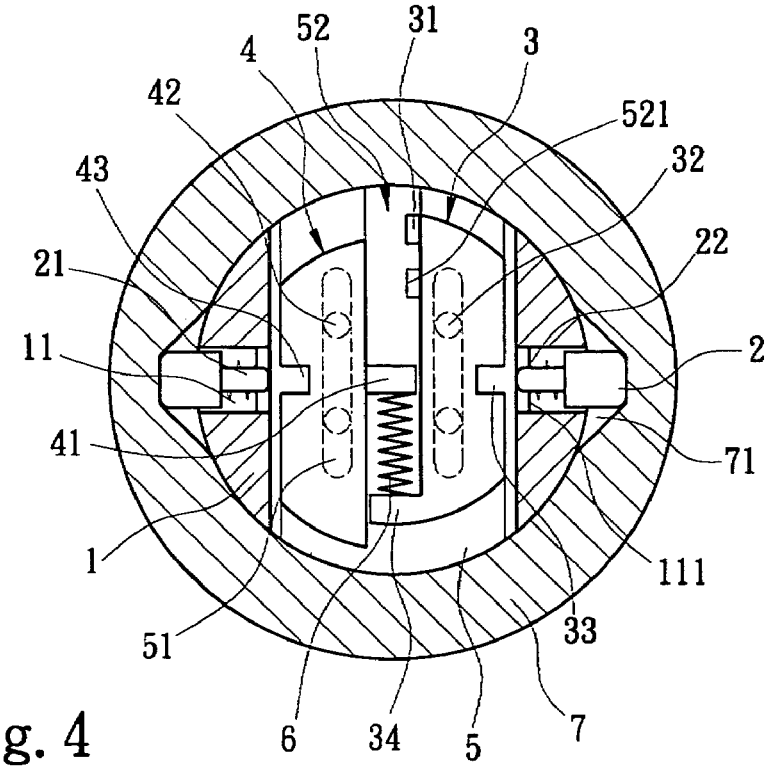
FIG. 4 is a second sectional view showing the lock core structure.

Please refer to FIG. 3. As shown, the first lock piece 4 and the second lock piece 3 are not shown, and the lock core 1, the latch element 2, the lock latching spring 22 and the lock piece sets are tightly assembled in a housing 7. The housing 7 includes a latching slot 71 for embedding the latch element 2 between the latching slot 7 and the embedding hole 11 of the lock core 1 as in a normal state. The inner edge of the latching slot 71 is formed by plural non-vertical slants so that when the latch element 2 is pushed, it can slide out of the latching slot 71 and move the bulge 21 of the latch element 2 to leave the fixing trough 53 of the division plate 5 by a latching spring 22. Please refer to FIG. 4 which shows a sectional view of the lock core including the first lock piece 4 and the second lock piece 3. The first lock piece 4 and the second lock piece 3 are slid along the sliding track 51 of the division plate 5 via the sliding elements 42, 32, and the first lock piece 4 and the second lock piece 3 are respectively have the first embedding slot 43 and the second embedding slot 33 corresponding to the fixing troughs 53 at the two sides of the division plate 5. When the first embedding slot 43 and the second embedding slot 33 are aligned with the division plate 5 to form a space for sliding in the latch elements, the turn of the key 8 can force the latch element 2 to slide into the space so as to turn the lock core 1 for unlocking.

Figure 5A:
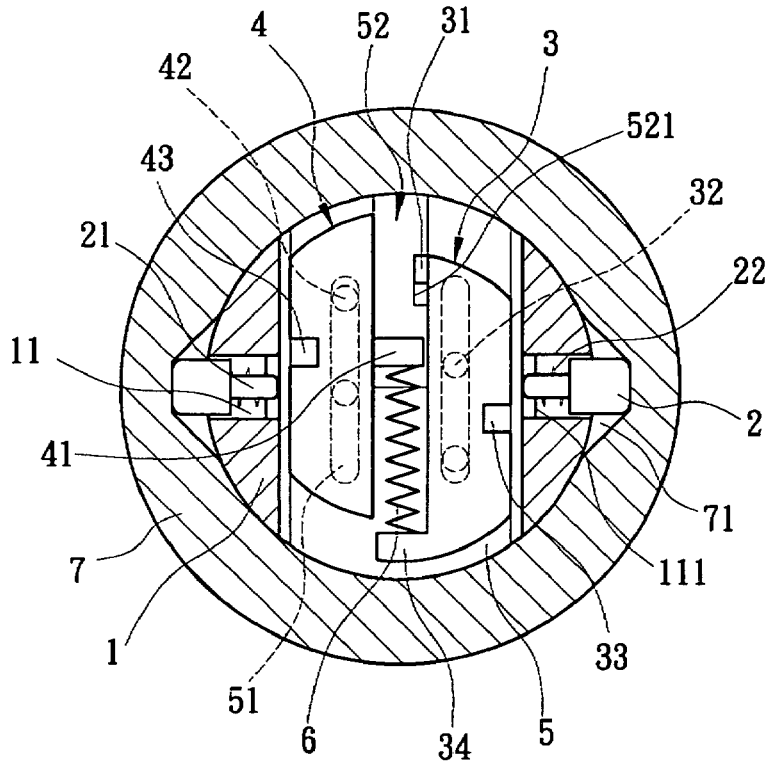
FIG. 5A is a schematic view showing an initial state of the lock core structure.
Figure 5B:
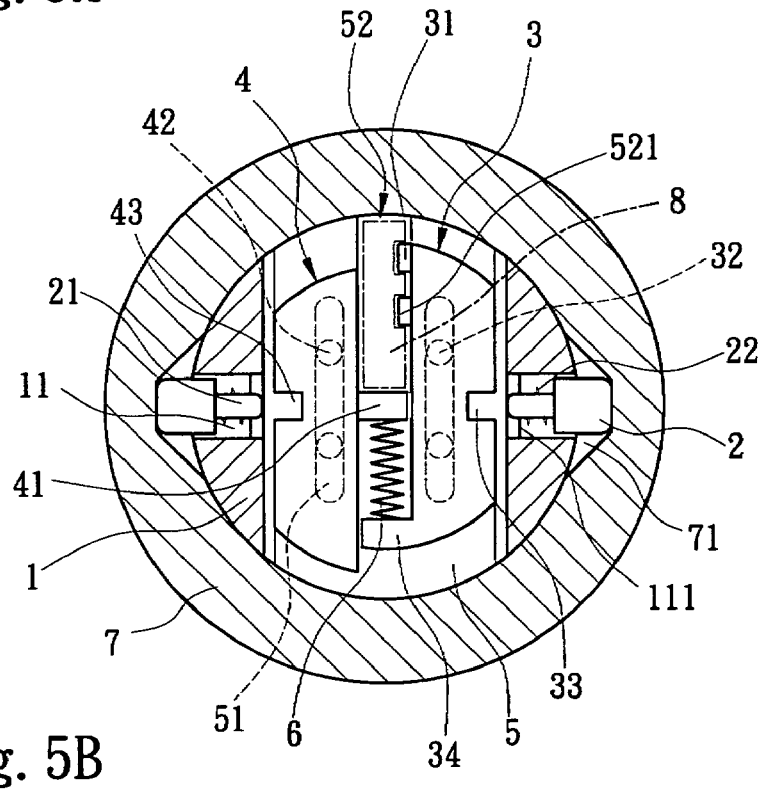
FIG. 5B is a schematic view showing an unlocked state of the lock core structure.

Please refer to FIG. 5A, which shows a locked initial state of the lock core structure. At the initial state, the first lock piece 4 and the second lock piece 3 are rejected by the elastic element 6 so that the first embedding slot 43 and the second embedding slot 33 are not aligned with the fixing trough 53. When an unmatched key 8 (as shown in FIG. 5B) is plugged in for turning the lock core 1, the lock core 1 can not be turned since the latch element 2 which latches the lock core 1 does not have a movement space, so that the locking function is achieved. Further, please refer to FIG. 5B, after a matched key 8 is plugged into the key through hole 52, the grooves on the key 8 will simultaneously reject against the first lock piece 4 and the second lock piece 3, so that the elastic element 6 will be compressed to force the first lock piece 4 and the second lock piece 3 to oppositely move. Then, the first embedding slot 43 and the second embedding slot 33 will simultaneously move and respectively align with the fixing troughs 53 at the two sides of the division plate 5. Therefore, when the lock core 1 is turned, the latch element 2 can slide into the first embedding slot 43, the second embedding slot 33 and the fixing troughs 53 for unlocking.

Figure 6A:
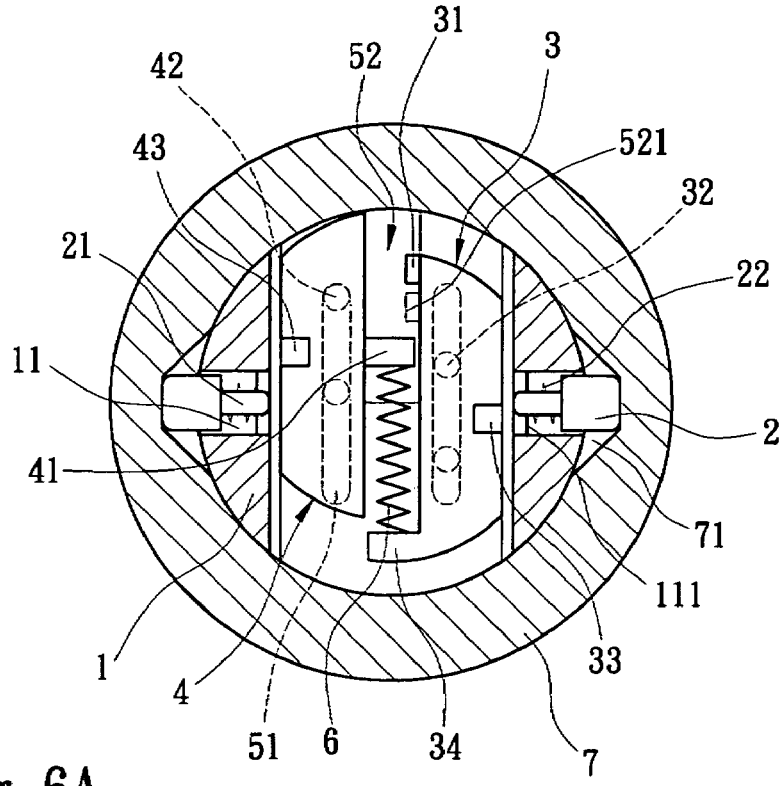
FIG. 6A is a first schematic view showing the interlocking between the first and the second lock pieces.
Figure 6B:
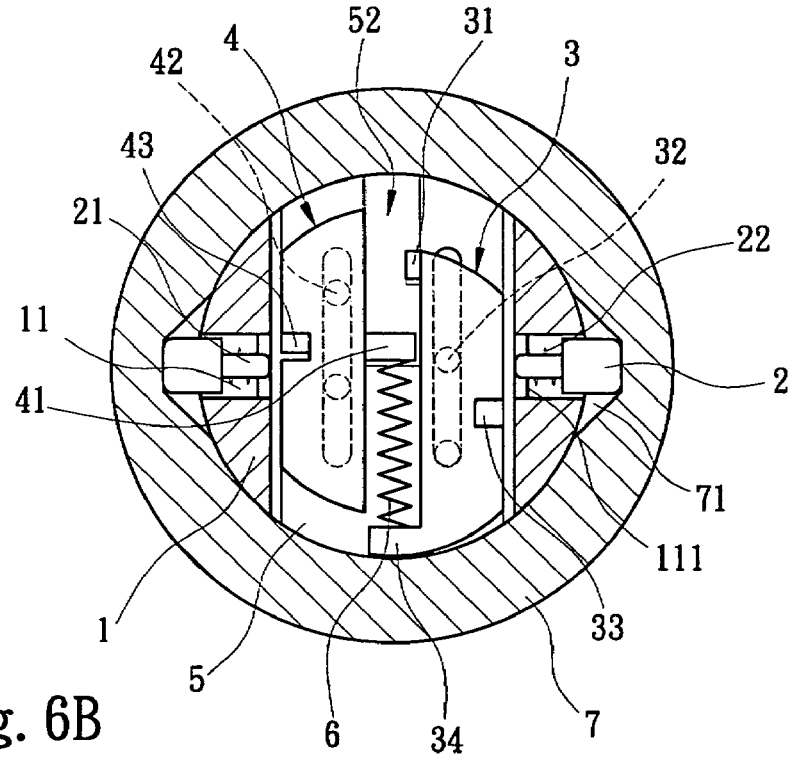
FIG. 6B is a second schematic view showing the interlocking between the first and the second lock pieces.

Please refer to FIGS. 6A and 6B, which are schematic views showing the interaction of the first lock piece 4 and the second lock piece 3. If only the second lock piece 3 is rejected, the second lock piece 3 will move upwardly, and at the same time, the rejecting shaft 34 of the second lock piece 3 will also drive the elastic element 6 to upwardly reject against the first key rejecting shaft 41 of the first lock piece 4, so that the first lock piece 4 will also move upwardly to force the first embedding slot 43 to leave the fixing trough 53 (which is covered in FIG. 6A), and the lock can not be unlocked. In FIG. 6B, if only the first lock piece 4 is rejected, the first key rejecting shaft 41 will push the elastic element 6, and at the same time, the second lock piece 3 will also move downwardly, so that the second embedding slot 33 will leave the fixing trough 53 (which is covered in FIG. 6B). Therefore, this interlocked structure is hard to break and the anti-theft effect can be achieved.

For enhancing the anti-theft function, plural lock piece sets can be mounted inside a lock core 1, and in each lock piece set, the first key rejecting shaft 41 and the second key rejecting shaft 31 can have different locations for creating the distance therebetween so as to increase the difficulty in unlocking. Moreover, the key orientation element 521 in the division plate 5 can further limit the shape of the key 8, so that through altering the shape, amount and position of the key orientation element 521, the key through hole 52 can block the unmatched key 8. Besides, the first key rejecting shaft 41 and the second rejecting shaft 31 can also have a circle section, and the elastic element 6 can be a spring.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock core structure having plural lock piece sets embedded therein, a key through hole and at least two embedding holes for proving space to at least two latch elements to move therein, the lock core, plural lock piece sets and latch element being tightly matched in a housing, wherein the lock piece set comprising:

a division plate embedded in the lock core and having a key through hole for passing through a key, a first sliding track and a second sliding track, and fixing troughs located at the positions corresponding to the embedding slots for sliding therein the latch elements;

a first lock piece having a sliding element mounted thereon for guiding thereof to slide along the sliding track on the division plate, a fist key rejecting shaft protrudently mounted at one side thereof near the key through hole, and a first embedding slot located at one side thereof corresponding to the fixing trough, and a second lock piece, mounted on the division plate opposite to the first lock piece, having a sliding element mounted thereon for guiding thereof to slide along the sliding track on the division plate, a second key rejecting shaft protrudently mounted at one side thereof near the key through hole, a second embedding slot located at one side thereof corresponding to the fixing trough, and a rejecting shaft for mounting an elastic element between the rejecting shaft and the first key rejecting shaft so as to form an interlocked structure between the first lock piece and the second lock piece.

2. The lock core structure as claimed in claim 1, wherein the first embedding slot and the second embedding slot are staggered in a normal state.

3. The lock core structure as claimed in claim 1, wherein the elastic element is a spring.

4. The lock core structure as claimed in claim 1, wherein the first key rejecting shaft and the second key rejecting shaft in each of plural lock piece sets are staggered.

5. The lock core structure as claimed in claim 1, wherein the first key rejecting shaft and the second key rejecting shaft respectively have a triangular section.

6. The lock core structure as claimed in claim 1, wherein the first key rejecting shaft and the second key rejecting shaft respectively have a circular section.

7. The lock core structure as claimed in claim 1, wherein the first key rejecting shaft and the second key rejecting shaft are offset vertically.

8. The lock core structure as claimed in claim 1, wherein the key through hole of the division plate further comprises at least a key orientation element.

9. The lock core structure as claimed in claim 1, wherein the housing has a latching slot for sliding the latch element therein.

10. The lock core structure as claimed in claim 9, wherein the inner wall of the latching slot is formed by non-vertical slants.

* * * * *